US005456327A

United States Patent [19]

Denton et al.

[11] Patent Number: 5,456,327

[45] Date of Patent: Oct. 10, 1995

[54] O-RING SEAL FOR ROCK BIT BEARINGS

[75] Inventors: Robert Denton, Friendswood; Madapusi K. Keshavan; Steven W. Peterson, both of The Woodlands, all of Tex.

[73] Assignee: Smith International, Inc., Houston, Tex.

[21] Appl. No.: 208,633

[22] Filed: Mar. 8, 1994

[51] Int. Cl.[6] ..... E21B 10/24

[52] U.S. Cl. ..... 175/371; 175/228; 175/374; 384/94; 277/96.2

[58] Field of Search ..... 175/371, 372, 175/228; 384/94; 277/92, 95, 96, 96.2, DIG. 6

[56] References Cited

U.S. PATENT DOCUMENTS

| | | | |
|---|---|---|---|
| 4,194,795 | 3/1980 | Rife | 277/92 X |
| 4,344,629 | 8/1982 | Oelke | 175/371 X |
| 4,557,609 | 12/1985 | Moren | 384/94 |
| 4,588,309 | 5/1986 | Uyehara et al. | 175/371 X |
| 5,099,519 | 4/1991 | Tatum | 175/372 X |
| 5,323,863 | 6/1994 | Denton | 175/371 X |

*Primary Examiner*—Stephen J. Novosad
*Attorney, Agent, or Firm*—Christie, Parker & Hale

[57] ABSTRACT

An improved O-ring seal for rock bit bearings comprises a body formed from a resilient elastomeric composition and a modified surface comprising a surface enhancing material integral with the body. The surface comprises a layer of surface enhancing material that encapsulates and is molecularly bonded to an underlying surface of an elastomeric seal body. The surface enhancing material selected may include metal disulfides, fluoropolymers, ethylene polymers, silicone polymers, and urethane polymers. The O-ring surface displays enhanced properties of reduced break-off friction, increased lubricity and wettablity, and increased thermal resistance. These enhanced surface properties serve to minimize stick-slip and material loss from the O-ring surface resulting from stick-slip, thereby increasing the service life of the O-ring seal and rock bit.

29 Claims, 1 Drawing Sheet

O-RING SEAL FOR ROCK BIT BEARINGS

FIELD OF THE INVENTION

This invention relates to an O-ring seal for retaining the lubricant around the journal bearings in a rock bit or drill bit for drilling oil wells or the like. More particularly, this invention relates to an O-ring seal having a modified surface composition serving to reduce the break-off friction of the O-ring, and thus reduce stick-slip and enhance the service life of the O-ring.

BACKGROUND OF THE INVENTION

Heavy-duty drill bits or rock bits are employed for drilling wells in subterranean formations for oil, gas, geothermal steam, and the like. Such drill bits have a body connected to a drill string and a plurality, typically three, of hollow cutter cones mounted on the body for drilling rock formations. The cutter cones are mounted on steel journals or pins integral with the bit body at its lower end. In use, the drill string and bit body are rotated in the bore hole, and each cone is caused to rotate on its respective journal as the cone contacts the bottom of the bore hole being drilled. As such a rock bit is used for drilling in hard, tough formations, high pressures and temperatures are encountered.

The total useful life of a drill bit in such severe environments is in the order of 20 to 200 hours for bits in sizes of about 6½ to 12¼ inch diameter at depths of about 5,000 to 20,000 feet that are operated at about 200 rpm. Useful lifetimes of about 65 to 150 hours are typical. However, the useful life of drill bits that are operated at higher revolutions such as 260 rpm, i.e., high-speed drill bits, is generally in the range of from about 20 to 50 hours. The cutter cones in such high-speed bit are operated at a rotation speed of approximately 375 rpm. The shortened useful life of the bit is often due to the increased frictional heat produced in the bit caused by the increased operating speed.

When a drill bit wears out or fails as a bore hole is being drilled, it is necessary to withdraw the drill string for replacing the bit. The amount of time required to make a round trip for replacing a bit is essentially lost from drilling operations. This time can become a significant portion of the total time for completing a well, particularly as the well depths become great. It is therefore quite desirable to maximize the service life of a drill bit in a rock formation. Prolonging the time of drilling minimizes the time lost in "round tripping" the drill string for replacing the bits. Replacement of a drill bit can be required for a number of reasons, including wearing out or breakage of the structure contacting the rock formation.

One reason for replacing the rock bits include failure or severe wear of the journal bearings on which the cutter cones are mounted. These bearings are subject to high pressure drilling loads, high hydrostatic pressures in the hole being drilled, and high temperatures due to drilling, as well as elevated temperatures in the formation being drilled. Considerable development work has been conducted over the years to produce bearing structures and to employ materials that minimize wear and failure of such bearings.

The journal bearings are lubricated with grease adapted to such severe conditions. Such lubricants are a critical element in the life of a rock bit. A successful grease should have a useful life longer than other elements of the bit so that premature failures of bearings do not unduly limit drilling. Failure of lubrication can be detected by generation of elevated pressure in the bit, evidence of which can often be found upon examination of a used bit. The high pressure is generated due to decomposition of the oil in the grease, with consequent generation of gas when lubrication is deficient and a bearing overheats due to friction. Lubrication failure can be attributed to misfit of bearings or O-ring seal failure, as well as problems with a grease.

Pressure and temperature conditions in a drill bit can vary with time as the drill bit is used. For example, when a "joint" of pipe is added to the drill string, weight on the bit can be relieved and slight flexing can occur. Such variations can result in "pumping" of the grease through O-ring seals, leading to loss of grease or introduction of foreign abrasive materials, such as drilling mud, that can damage bearing surfaces. One of the consistent problems in drill bits is the inconsistency of service life. Sometimes bits are known to last for long periods, whereas bits which are apparently identical operated under similar conditions may fail within a short lifetime. One cause of erratic service life is failure of the bearings. Bearing failure can often be traced to failure of the seal that retains lubricant in the bearing. Lubricant may be lost if the seal fails, or abrasive particles of rock may work their way into the bearing surfaces, causing excessive wear.

Rock bit O-rings are being called on to perform service in environments which are extremely harsh. Modern bits are being run at exceptionally high surface speeds, sometimes more than 500 feet per minute, with cone speeds averaging in the range of from 200 to 400 revolutions per minute. One face of the O-ring is exposed to abrasive drilling mud. The life of the O-ring may be significantly degraded by high temperatures due to friction (as well as elevated temperature in the well bore) and abrasion.

In order to provide a consistently reliable O-ring seal for maintaining the lubricant within rock bits, it is known to make the O-ring seal from a resilient elastomeric composition displaying a desire degree of chemical resistance, heat resistance, and wear resistance. O-ring seals known in the art are constructed from resilient elastomeric materials that, while displaying some degree of chemical, heat, and wear resistance, have ultimately limited the service life of the rock bit by wearing away or suffering material loss along the O-ring surface during use.

It is therefore desirable to provide a consistently reliable O-ring seal for maintaining the lubricant within a rock bit, that has a long useful life, is resistant to crude gasoline and other chemical compositions found within oil wells, has high heat resistance, is highly resistant to abrasion, has a modified surface having a reduced break-off friction to minimize heating and wear caused by the occurrence of stick-slip between adjacent seal surfaces, and that will not readily deform under load and allow leakage of the grease from within the bit or drilling mud into the bit.

SUMMARY OF THE INVENTION

There is, therefore, provided in practice of this invention an improved O-ring seal for rock bit bearings. An improved O-ring seal comprises a body formed from a resilient elastomeric composition, and a modified surface having a molecular makeup different from the body that it encloses and which is molecularly bonded to the body.

The modified surface may consist of materials including metal disulfide such as tungsten disulfide and molybdenum disulfide, fluoropolymers such as polytetrafluoroethylene, polyethylene polymers, silicone polymers, and urethane polymers. The material is molecularly bonded to a surface portion of the O-ring seal body by using surface modification techniques such as plasma polymerization and the like. The modified surface may have a film thickness in the range of from 100 to 500 Angstroms.

The modified O-ring seal surface displays enhanced surface properties such as decreased break-off friction, increased lubricity and wettablity, and increased thermal resistance when compared to the elastomeric body, serving to minimize sticking between the O-ring surface and adjacent sealing surfaces and, therefore minimizing the material loss at the O-ring surface resulting from stick-slip. In this manner the enhanced surface properties of the O-ring seal serves to extend the life of the O-ring and rock bit.

BRIEF DESCRIPTION OF THE DRAWINGS

A rock bit containing an O-ring seal constructed according to the principles of this invention is illustrated in semi-schematic perspective in FIG. 1 and in partial cross-section in FIG. 2.

DETAILED DESCRIPTION

Figure 1:
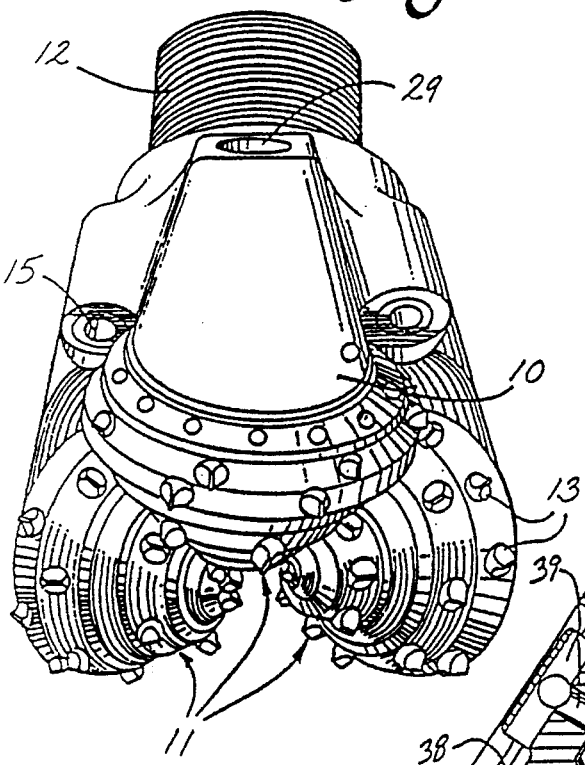

A rock bit employing an O-ring seal constructed according to principles of this invention comprises a body 10 having three cutter cones 11 mounted on its lower end, as shown in FIG. 1. A threaded pin 12 is at the upper end of the body for assembly of the rock bit onto a drill string for drilling oil wells or the like. A plurality of tungsten carbide inserts 13 are pressed into holes in the surfaces of the cutter cones for bearing on the rock formation being drilled. Nozzles 15 in the bit body introduce drilling mud into the space around the cutter cones for cooling and carrying away formation chips drilled by the bit.

O-ring seals are generally thought of as comprising a cylindrical inside diameter, outside diameter, and a cylindrical cross section. Accordingly, for purposes of reference and clarity, the figures used to describe the principles and embodiments of this invention have been created to illustrate an O-ring seal having a generally circular cross section. However, the principles of this invention are also meant to apply to O-ring seals having non-cylindrical cross sections, such as an elliptical cross section and the like. Therefore, it is to be understood that the principles of this invention may apply to O-rings having a circular or non-circular cross sections.

Figure 2:
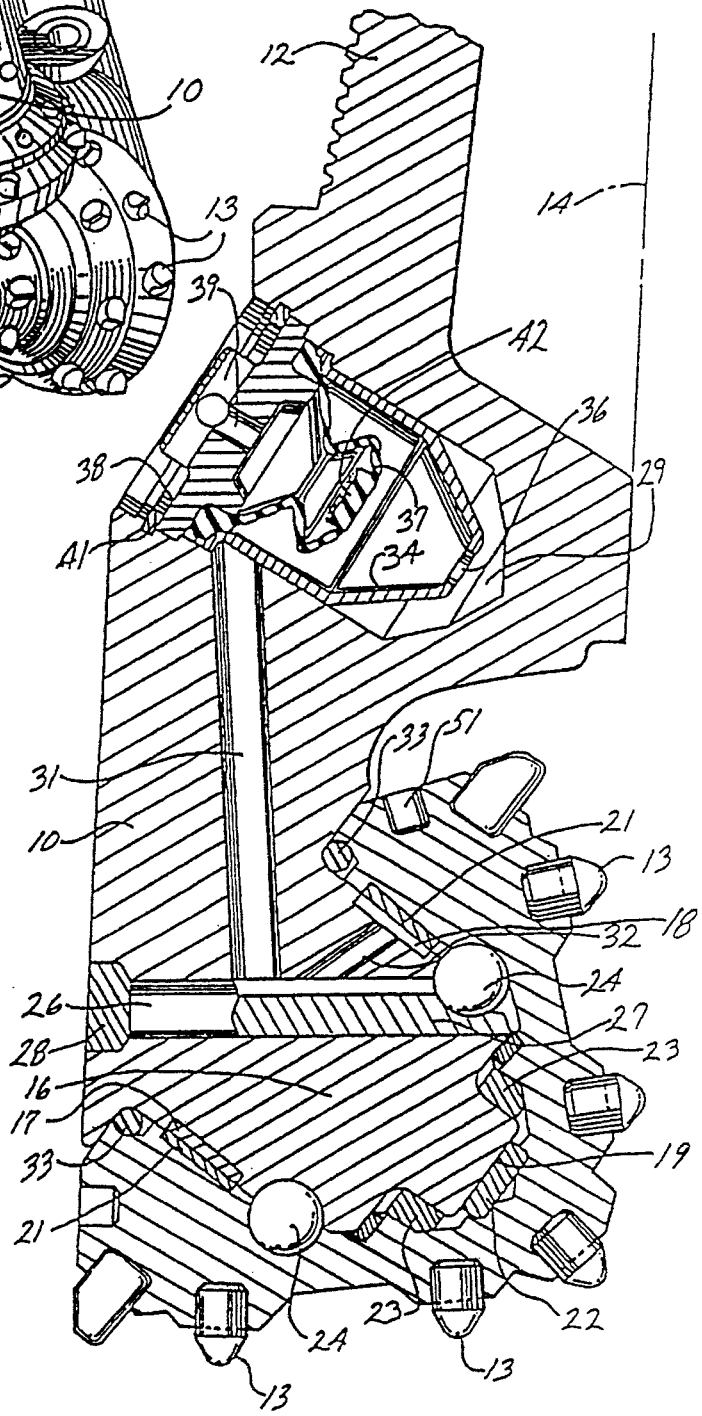

FIG. 2 is a fragmentary, longitudinal cross-section of the rock bit, extending radially from the rotational axis 14 of the rock bit through one of the three legs on which the cutter cones 11 are mounted. Each leg includes a journal pin extending downwardly and radially, inwardly on the rock bit body. The journal pin includes a cylindrical bearing surface having a hard metal insert 17 on a lower portion of the journal pin. The hard metal insert is typically a cobalt or iron-based alloy welded in place in a groove on the journal leg and having a substantially greater hardness that the steel forming the journal pin and rock bit body.

An open groove 18 is provided on the upper portion of the journal pin. Such a groove may, for example, extend around 60 percent or so of the circumference of the journal pin, and the hard metal insert 17 can extend around the remaining 40 percent or so. The journal pin also has a cylindrical nose 19 at its lower end.

Each cutter cone 11 is in the form of a hollow, generally-conical steel body having cemented tungsten carbide inserts 13 pressed into holes on the external surface. For long life, the inserts may be tipped with a polycrystalline diamond layer. Such tungsten carbide inserts provide the drilling action by engaging a subterranean rock formation as the rock bit is rotated. Some types of bits have hard-faced steel teeth milled on the outside of the cone instead of carbide inserts.

The cavity in the cone contains a cylindrical bearing surface including an aluminum bronze insert 21 deposited in a groove in the steel of the cone or as a floating insert in a groove in the cone. The aluminum bronze insert 21 in the cone engages the hard metal insert 17 on the leg and provides the main bearing surface for the cone on the bit body. A nose button 22 is between the end of the cavity in the cone and the nose 19 and carries the principal thrust loads of the cone on the journal pin. A bushing 23 surrounds the nose and provides additional bearing surface between the cone and journal pin. Other types of bits, particularly for higher rotational speed applications, have roller bearings instead of the exemplary journal bearings illustrated herein. It is to be understood that an O-ring seal constructed according to principles of this invention may be used with rock bits comprising either roller bearings or conventional journal bearings.

A plurality of bearing balls 24 are fitted into complementary ball races in the cone and on the journal pin. These balls are inserted through a ball passage 26, which extends through the journal pin between the bearing races and the exterior of the rock bit. A cone is first fitted on the journal pin, and then the bearing balls 24 are inserted through the ball passage. The balls carry any thrust loads tending to remove the cone from the journal pin and thereby retain the cone on the journal pin. The balls are retained in the races by a ball retainer 27 inserted through the ball passage 26 after the balls are in place. A plug 28 is then welded into the end of the ball passage to keep the ball retainer in place. The bearing surfaces between the journal pin and the cone are lubricated by a grease. Preferably, the interior of the rock bit is evacuated, and grease is introduced through a fill passage (not shown). The grease thus fills the regions adjacent the bearing surfaces plus various passages and a grease reservoir, and air is essentially excluded from the interior of the rock bit. The grease reservoir comprises a cavity 29 in the rock bit body, which is connected to the ball passage 26 by a lubricant passage 31. Grease also fills the portion of the ball passage adjacent the ball retainer, the open groove 18 on the upper side of the journal pin, and a diagonally extending passage 32 therebetween. Grease is retained in the bearing structure by a resilient seal in the form of an O-ring 33 between the cone and journal pin. Preferably, the O-ring is in a slightly V-shaped groove.

A pressure compensation subassembly is included in the grease reservoir 29. The subassembly comprises a metal cup 34 with an opening 36 at its inner end. A flexible rubber bellows 37 extends into the cup from its outer end. The bellows is held into place by a cap 38 with a vent passage 39. The pressure compensation subassembly is held in the grease reservoir by a snap ring 41.

When the rock bit is filled with grease, the bearings, the groove 18 on the journal pin, passages in the journal pin, the lubrication passage 31, and the grease reservoir on the outside of the bellows 37 are filled with grease. If the volume of grease expands due to heating, for example, the bellows 37 is compressed to provide additional volume in the sealed grease system, thereby preventing accumulation of excessive pressures. High pressure in the grease system can damage the O-ring seal 33 and permit drilling mud or the like to enter the bearings. Such material is abrasive and can quickly damage the bearings. Conversely, if the grease volume should contract, the bellows can expand to prevent low pressures in the sealed grease system, which could cause flow of abrasive and/or corrosive substances past the O-ring seal.

The bellows has a boss 42 at its inner end which can seat against the cap 38 at one end of the displacement of the bellows for sealing the vent passage 39. The end of the bellows can also seat against the cup 34 at the other end of its stroke, thereby sealing the opening 36. If desired, a pressure relief check valve can also be provided in the grease reservoir for relieving over-pressures in the grease system that could damage the O-ring seal. Even with a pressure compensator, it is believed that occasional differential pressures may exist across the O-ring of up to ±150 psi (548 kilopascals).

To maintain the desired properties of the O-ring seal at the pressure and temperature conditions that prevail in a rock bit, to inhibit "pumping" of the grease through the O-ring seal, and for a long useful life, it is important that the O-ring seal be resistant to crude gasoline and other chemical compositions found within oil wells, have a high heat and abrasion resistance, have low rubbing friction, and not be readily deformed under the pressure and temperature conditions in a well which could allow leakage of the grease from within the bit or drilling mud into the bit.

Therefore, it is desired that the O-ring seal have a modulus of elasticity at 100 percent elongation of from 850 to 1275 psi (6 to 9 megapascals), a minimum tensile strength of 2300 psi (16 megapascals), elongation of from 200 to 350 percent, die C tear strength of at least 250 lb/in. (4.5 kilogram/millimeter), durometer hardness Shore A in the range of from 75 to 85, and a compression set after 70 hours at 100° C. of less than about 18 percent and preferably less than about 16 percent.

A variety of O-rings seals have been employed in such rock bits. Such O-rings typically comprise acrylonitrile polymers or acrylonitrile/butadiene copolymers. Other components in the polymers are activators or accelerators for the curing, such as stearic acid, and agents that add to heat resistance of the polymer, such as zinc oxide and curing agents. However, these synthetic rubbers typically exhibit poor heat resistance and become brittle at elevated temperatures after extended periods of time. Additionally, such compounds often exhibit undesirably low tensile strength and high coefficients of friction. Such properties are undesirable for a seal in a rock bit, since the high operating temperatures of the bit result in frequent failure of the seal.

Preferred O-ring seals can be formed from the group of elastomeric compositions including fluoroelastomers, carboxylated elastomers such as carboxylated nitriles, and highly saturated nitrile (HSN) elastomers and the like. A particularly preferred O-ring seal is made from an HSN resilient elastomer material and is disclosed in U.S. patent application Ser. No. 07/884,657 that is assigned to the same assignee as the present invention and is hereby incorporated by reference. An exemplary elastomeric composition may comprise per 100 parts by weight of highly-saturated nitrile elastomer, furnace black in the range of from 40 to 70 parts by weight, peroxide curing agent in the range of from 7 to 10 parts by weight, graphite in the range of from 10 to 20 parts by weight, zinc oxide or magnesium oxide in the range of from 4 to 7 parts by weight, stearic acid in the range of from 0.5 to 2 parts by weight, and plasticizer up to about 10 parts by weight.

A mechanism of failure in a rock bit O-ring may be characterized as stick-slip. As the elastomer of the O-ring moves along the metal surface of the leg or cone, the O-ring material momentarily sticks to the metal surface. Almost instantly the elastomer then slips relative to the metal. The O-ring slips because the rotational force of the O-ring is sufficient to overcome the break-off friction between the adjacent sealing surfaces. This making and breaking of bonds between the elastomer and metal dissipates energy and causes frictional heating. Furthermore, if too strong a bond is formed between the elastomer and metal, some of the elastomer may be removed from the O-ring, thereby degrading the surface.

It is therefore desirable to minimize the amount of sticking between the elastomer and metal. Such sticking is minimized in practice of this invention by modifying the surface of the O-ring without changing the bulk properties of the main body of the O-ring in such a manner as to reduce the break-off friction and increase the lubricity and wettablity of the O-ring seal surface.

In elastomeric materials the tensile modulus of the elastomer, its tear strength and hardness are positively correlated. When the hardness of the elastomer is increased, one normally finds that the modulus and tear strength are also increased. Hardness is therefore a convenient means for comparing the properties of elastomers. For a rock bit O-ring, it is desirable that the durometer hardness of the O-ring is in the range of from about 75 to 85 on the Shore A scale. Typically, the hardness of the O-ring is about 80 Shore A. A hardness as high as 85 may result in premature failure of an O-ring at the same squeeze. Typically, in a rock bit, the squeeze of the O-ring in the seal is from about 7.5 to 10.5 percent, preferably toward the high end of the range for reliable sealing. It is desirable to maintain a squeeze in about this range and a bulk hardness in the order of 78 to 83, but to also increase the surface hardness and hence modulus and tear strength.

A way of modifying the surface properties of the O-ring without changing the bulk properties of the body of the O-ring is to plasma treat the surface with an inert gas containing a reactive gas species such as chlorine or fluorine. The chlorinated or fluorinated nitrile rubber modules which form at the surface of the O-ring due to such treatment modify or change the surface of the O-ring by increasing its lubricity and/or by decreasing its break-off friction. Additionally, the modified surface may also have a hardness different than that of the elastomeric body. The modified properties of the O-ring surface tends to reduce the occurrence of stick-slip and any material loss as a consequence of stick-slip. While not wishing to be bound by any particular theory or mechanism, it is believed that the fluorination of the surface causes reduced break-off friction and reduced occurrences of stick-slip due to enhanced lubricity and wettablity characteristics, minimizing the "sticking" portion of the stick-slip phenomenon.

It is also believed that the reduced occurrence of stick-slip may be caused by enhancing the thermal resistance of the modified O-ring surface. The materials that are used to treat the surface of O-ring have an enhanced thermal resistance when compared to the elastomeric O-ring body. This enhanced thermal resistance is believed to reduce the sticking portion of the stick-slip phenomena at the O-ring surface and, therefore, serves to reduce the amount material loss and degradation at the O-ring surface.

The properties of the surface may also be changed by grafting a different molecule to the nitrile molecules adjacent to the surface of the O-ring. Preferably molecules adjacent to the surface are copolymerized with a fluoropolymer. Other polymers that may be suitable include polyethylene, silicones and polyurethanes.

Such potential copolymers are grafted to the nitrile polymer by high energy plasma treatment. A high energy plasma comprises a highly ionized and accelerated gas, typically, an inert gas such as argon, nitrogen or the like. Other gaseous species such as a fluorocarbon polymer may be introduced into such a plasma. When such highly energetic polymers encounter the elastomeric nitrile rubber, bonds in the nitrile and in the fluorocarbon or the like may be disrupted, thus, providing an opportunity for molecularly bonding the fluorocarbon to the nitrile substrate. This, of course, changes the surface properties of the O-ring without changing its bulk properties.

A graft polymer may also be formed on the surface of an O-ring by a variation of this process. A polymer may be applied to the surface by dipping, spraying or the like. Thereafter, the surface is subjected to plasma treatment and the energetic plasma disrupts both nitrile and non-nitrile polymers leading to molecular bonding therebetween.

One may also increase the surface hardness of the elastomeric nitrile rubber by treatment with sulfur. It is believed that nitrile rubber continues to cure or cross-link during elevated temperature service even though the nitrile is nominally completely cured. Elevated temperatures increase hardness of nitrile as well as other rubbers and this may be due to increased cross-linking. Sulfur tends to promote cross-linking of rubber and treatment of the nitrile surface with sulfur may enhance cross-linking and hardness adjacent to the surface of the O-ring. Such sulfur treatment may be by energetic sulfur introduced into an inert gas plasma.

An alternative method used to modify the surface of the O-ring is to deposit a few microns of tungsten disulfide onto the surface of the elastomer by the dip process and subsequently drying the O-ring in an oven. This surface modification technique, like that previously discussed above, also enhances the surface properties of the O-ring, lowers break-off friction and, thus reduces the tendency for stick-slip.

When the surface properties of the O-ring are modified in this manner the O-ring continues to provide a seal for the grease since the bulk properties of the O-ring are unchanged and the effect of squeeze is unchanged. The modified surface properties, however, tend to reduce break-off friction, minimize stick-slip and minimize material loss at the O-ring surface.

A carboxylated elastomeric nitrile polymer may be preferred. The carboxylated polymer appears to have improved properties for a rock bit O-ring as compared with other HSN rubber, including resistance to hardening with age at elevated temperature.

An O-ring seal relies upon the lubricant within the rock bit for lubrication. During normal use of a rock bit, it has been discovered that O-ring seals made from the elastomeric composition have an average life of approximately 25 to 30 hours at a squeeze of about 10.5 percent when the cutter cones are operated at approximately 375 rpm. The average life of the elastomeric O-ring seal is limited by frictional heat that occurs at the O-ring surface and the material loss related to stick-slip caused by the interaction between the adjacent cone and the journal surfaces. As the cone rotates on the journal and along the surface of the O-ring, the frictional heat generated at the interacting O-ring surface causes the seal material to degrade. Ultimately, the degradation of the O-ring seal either permits the grease within the rock bit to escape or permits the entrance of abrasive drilling mud or the like into the cone. The occurrence of either of the above conditions is sufficient to cause the rock bit bearings to fail, ending the useful life of the rock bit.

It has been discovered that an O-ring comprising the elastomeric composition can be constructed in such a manner that it provides a lower coefficient of friction at the surface of the seal and, thus results in a lower degree of material loss than O-ring seals made entirely from the elastomeric composition alone. An O-ring seal constructed according to principles of this invention having a lower coefficient of friction minimizes the amount of frictional heat generated between the cone and the journal and stick-slip, a known cause of rock bit failure.

An embodiment of an O-ring seal constructed according to principles of this invention comprises a body formed from an elastomeric composition such as one selected from the group of elastomeric materials previously described, and an enhanced surface enclosing the body formed from a uniform layer of material having a different molecular makeup than the body. A preferred material may be selected from the group of metal sulfides including tungsten disulfide ($WS_2$) and molybdenum disulfide ($MoS_2$) and the like. A particularly preferred surface enhancing material is tungsten disulfide. The material used to enhance the properties of the surface can be applied using well known surface deposition techniques such as by chemical dipping, vapor deposition or the like. However, to afford enhanced properties of reduced break-off friction to the surface of the O-ring seal without substantially increasing the dimension of the seal, it is desired that the material used to enhance the surface actually molecularly bond with or impregnate the structure of the substrate O-ring body. Techniques for impregnating or molecularly bonding such materials to the surface of a substrate are relatively new and are not well known in the art. A preferred technique for impregnating or molecularly bonding the material to the body of the O-ring seal is by chemical dipping, wherein the O-ring seal is emersed or dipped into a liquid solution of surface enhancing material and then allowed to air dry, such as that conducted by Diversified Drilube, Inc., of Tulsa, Okla. under a process that it refers to as the Ultralube process. During the chemical dipping deposition technique, the lamellar crystal structure of the tungsten disulfide dry lubricant is believed to impregnate and molecularly fuse with the surface portion of the substrate O-ring body without the use of heat, resins, or any other binders. The molecular interlock established between the seal body and the enhancing material layer is so complete that only removal of the elastomeric material of the seal body itself can affect the enhanced properties of the modified O-ring surface.

Accordingly, a preferred O-ring seal comprises a body formed from an elastomeric composition and a surface formed from a uniform layer of material that encloses and molecularly bonds with the body via the deposition technique described above. The technique of molecularly fusing the enhancing material onto the body permits the formation of a strongly adhered and durable thin film that provides the desired degree of surface enhancement without having to use multiple layers.

The ability to achieve a surface layer having the desired enhanced properties using only a thin film of material eliminates potential complications that may develop when fitting together parts having close spatial tolerances. Accordingly, the use of a molecularly bonded material layer eliminates the need to reconfigure existing O-ring seals to accommodate the surface layer thickness and, therefore is economically desirable. A preferred surface layer may have a thickness in the range of from 100 to 500 Angstroms (Å).

An O-ring seal constructed according to the above described principles has been shown to display decreased break-off friction, increased lubricity and wettablity, and increased thermal resistance at the surface of the O-ring as compared with O-rings constructed entirely from the elastomeric material alone. These enhanced properties have been shown to enhance the service life of the O-ring and, thus the service life of a rock bit incorporating the same by as much as two times. An additional advantage of constructing an O-ring according to such principles is that, while the surface of the O-ring displays improved properties of reduced break-off friction and the like, the body of the O-ring formed from the elastomeric composition retains all of the desired physical properties, such as the desired modulus of elasticity, tensile strength, elongation, tear strength, durometer hardness and a low compression set. A further advantage, as mentioned above, is that the overall dimension of the O-ring seal remains substantially the same, eliminating potential spatial tolerance complications as well as permitting the use of existing O-ring seals.

Alternatively, the surface of the O-ring seal may comprise a uniform layer of material that encloses and is molecularly bonded to the body. The material may be selected from the group of polymeric materials including fluoropolymers, polyethylene polymers, silicone polymers, urethane polymers and the like. A particularly preferred material is polytetrafluoroethylene (PTFE). The surface enhancing material can be applied to the body of the O-ring seal by using previously described deposition techniques such as chemical dip, chemical vapor deposition and the like. However, it is desired that the material be part of the intermolecular makeup of the surface portion of the O-ring body, thereby providing enhanced properties of reduced break-off friction, increased lubricity and wettablity, and increased thermal resistance at the O-ring surface without significant layer thickness. Additionally, a layer of surface enhancing material that is molecularly bonded to the surface of the O-ring seal will not flake away like a surface layer that is merely coated onto the substrate surface.

A preferred method for applying and molecularly fusing the alternative surface enhancing material to the O-ring body is by plasma polymerization, which occurs in a polymerization chamber under a vacuum environment, using various gas phase monomers and catalyst. The O-ring seal is placed into the chamber where gas phase monomers are introduced and ionized by using a radio frequency energy field, causing the monomers to break apart to form ions and free electrons. It is believed that some of the ions bombard the surface of the O-ring seal body, removing some portions of the molecules along the surface. Other ions are believed to recombined with each other and attach themselves to the surface of the O-ring seal at the site where the O-ring seal surface molecules have been disrupted or removed, replacing the surface molecules and forming a new polymeric surface layer comprising the desired surface enhancing material. The process of ion recombination and attachment to the O-ring seal body continues until a desired layer thickness of the plasma polymerized film is achieved. Plasma polymerization forms a thin film of the desired surface enhancing material that is molecularly bonded or grafted to the O-ring body substrate material that will not flake off or leach out after being applied.

The thickness of the surface layer can be controlled by varying the conditions of the plasma polymerization and may range between 25 and 1000 Å. A preferred O-ring seal comprises a surface layer having a thickness in the range of 100 to 500 Å. Like the use of the chemical dipping deposition technique previously described, the use of the plasma polymerization process to molecularly graft a desired surface enhancing material into the body of the O-ring body permits the formation of an extremely strong thin-film layer which does not noticeably alter the overall dimensions of the O-ring seal.

A particularly preferred plasma polymerization process is one conducted by Metro-Line Industries, Inc. of Corona, Calif., using a three stage gas plasma surface modification process. First, the surface of the O-ring body undergoes an atomic cleaning process to remove all organic contaminants, leaving an atomically clean body. Second, the chemical structure of the surface of the O-ring body is molecularly modified by ion bombardment at a high rate of speed during the ionization cycle of the plasma polymerization process. During ion bombardment the ions impact the surface of the O-ring seal body, causing the polymer backbone to fracture. Some of the charged molecules then attached themselves to the surface of the O-ring body, forming a new chemical structure. Finally, some of the ions recombine to form the desired polymeric surface enhancing material, e.g., PTFE, during the plasma polymerization process and molecularly graft with the molecularly modified surface of the O-ring seal body, forming an entirely new surface comprising the desired surface enhancing polymer.

O-ring seals constructed according to the above described principles of this invention have been shown to display reduced break-off friction, increased lubricity, and increased thermal resistance at the O-ring surface as compared with O-rings constructed entirely from only the elastomeric composition. The modified surface layer displays an increased lubricity due to an enhanced wettablity of the new modified surface. The ability of the modified surface to wet or attract and retain a fluid, e.g., the rock bit lubricant, maximizes the lubricated interface between the O-ring seal and cone and, thus reduces frictional heat and break-off friction, minimizing stick-slip between adjacent sealing surfaces and extending the service life of the O-ring and rock bit.

It is to be understood that an O-ring seal may be constructed differently than specifically described above and not depart from the scope of this invention. For example, an O-ring seal may be constructed having a layer of surface enhancing material molecularly bonded, to only a portion of the O-ring seal body, i.e., that portion of the O-ring body that is subjected to stick-slip, and therefore material loss. In this embodiment, the surface enhancing material would not completely encapsulate the entire O-ring body.

Laboratory tests have been conducted comparing various physical characteristics of improved O-ring seals constructed according to principles of this invention with O-ring seals formed from only an elastomeric composition comprising HSN. Table 1 shows a series of test results comparing the physical characteristics of an O-ring seal formed entirely from the HSN material (Standard equals an average of the test results from nine tests) with those of O-ring seals each comprising a body formed from the HSN elastomeric material and an enhanced surface layer formed from a molecularly bonded surface enhancing material previously described (Tests 1 through 5). The O-rings tested were those typically used in 12¼ inch rock bits, having an inside diameter (ID) of approximately 2.9 inches (73 millimeters), a cross section of approximately 0.3 inches (7.6 millimeters), and an outside diameter (OD) of approximately 3.5 inches (89 millimeters). All of the tests were conducted under similar conditions of cone revolution (375 rpm) and percent squeeze (approximately 10.6 percent).

TABLE 1

SEAL WEAR TEST RESULTS

| Test No. | Standard | Test #1 | Test #2 | Test #3 | Test #4 | Test #5 |
|---|---|---|---|---|---|---|
| Rock Bit Size (inches) | 12¼ | 12¼ | 12¼ | 12¼ | 12¼ | 12¼ |
| O-Ring Size (OD-inches) | 3.5 | 3.5 | 3.5 | 3.5 | 3.5 | 3.5 |
| Speed, rpm | 375 | 375 | 375 | 375 | 375 | 375 |
| O-Ring Material | HSN | HSN | HSN | HSN | HSN | HSN |
| Coating | — | $WS_2$ | $WS_2$ | $WS_2$ | PTFE | PTFE |
| Life | 27.4 | 64 | 49 | 58 | 42 | 49 |
| Time To Smooth (hours) | — | — | — | 20 | 3.5 | 33 |
| Durometer (Shore A) | 83 | 85 | 85 | 85 | 82 | 81 |
| Percent Squeeze | 10.6 | 10.6 | 10.8 | 10.5 | 10.9 | 10.6 |
| Surface Finish (Ra) | 20 | 32 | 28 | 25 | 21 | 15 |
| Ave. Leg Temp. (F) | 270 | 296 | 263 | 227 | 234 | 328 |
| Ave. Cone Temp. (F) | 227 | 222 | 229 | N/A | 206 | 216 |
| Ave. Torque (in-lbs) | 222 | 266 | 397 | 339 | 143 | 236 |
| Max. Leg Temp. (F) | 397 | 494 | 494 | 347 | 500 Plus | 491 |
| Max. Cone Temp. (F) | 306 | 324 | 436 | N/A | 308 | 391 |
| Max. Torque (in-lbs) | 559 | 534 | 867 | 492 | 734 | 505 |

As shown in Table 1, the average life for an O-ring seal formed entirely from the HSN elastomeric material subjected to a cutter cone speed of approximately 375 rpm is 27.4 hours (Standard). Test number 1 is an example of a first embodiment of an improved O-ring seal comprising a body formed from the HSN elastomeric material and a surface layer of molecularly bonded tungsten disulfide applied via the dip process. Test 1 displayed a service life of approximately 64 hours, approximately 2.3 times greater than the O-ring seal comprising HSN alone. Test numbers 2 and 3 are identical examples of a first embodiment of an improved O-ring, each displaying a service life of approximately 49 hours and 58 hours, respectively. Accordingly, the average service life for a first embodiment of an O-ring seal comprising an enhanced surface layer of molecularly bonded tungsten disulfide, as represented in Tests 1, 2, and 3 is approximately 57 or 2 times the service life of the O-ring seal formed entirely from the HSN elastomeric composition.

Tests 4 and 5 are of a first embodiment of an improved O-ring seal comprising a body formed from the HSN elastomeric material and a surface layer with molecularly bonded PTFE applied via the plasma polymerization process. Tests 4 and 5 registered service lives of 42 and 49 hours, respectively. Accordingly, the average service life for first embodiment of the O-ring seal, comprising an enhanced surface layer of molecularly bonded PTFE, is approximately 45.5 hours or 1.7 times the service life of the O-ring seal formed entirely from the HSN elastomeric composition.

These results of these tests illustrate the enhanced surface properties of an improved O-ring seal constructed according to principles of this invention and the effect that such enhanced surface properties have in extending the service life of a rock bit by two times, and in some cases more than that, over O-ring seals formed from the HSN elastomeric material alone.

Although, limited embodiments of an improved O-ring seal for rock bit bearings have been described and illustrated herein. Many modifications and variations will be apparent to those skilled in the art. Accordingly, it is to be understood that within the scope of the appended claims, the improved O-ring seal for rock bit bearing according to principles of this invention may be embodied other than as specifically described herein.

What is claimed is:

1. A rotary cone rock bit for drilling subterranean formations comprising;

a bit body including a plurality of journal pins each extending from a leg portion of the bit and having a bearing surface;

a cutter cone rotatably mounted on each journal pin and including a bearing surface;

a pressure-compensated grease reservoir in communication with such bearing surfaces;

a grease in the grease reservoir and adjacent the bearing surfaces; and a dynamic O-ring seal for retaining the grease in the bearing comprising:

a body formed from a resilient elastomeric composition; and a surface portion integral with the body forming a permanent surface on the body for engaging a journal pin and a cone and having properties different from the properties of the body, wherein the surface portion comprises a material different from the elastomeric composition, and wherein the surface portion is molecularly bonded to the elastomeric composition.

2. The rotary cone rock bit as recited in claim 1 wherein the surface portion is integral with the elastomeric body and comprises enhanced properties of reduced break-away friction, increased lubricity and wettablity, and increased thermal resistance as compared to the elastomeric body.

3. The rotary cone rock bit as recited in claim 1 wherein the body comprises a nitrile rubber and the surface portion comprises at least a portion of nitrile rubber having a molecular structure different from the molecular structure of the nitrile rubber of the body.

4. The rotary cone rock bit as recited in claim 3 wherein the nitrile rubber of the surface portion is halogenated.

5. The rotary cone rock bit as recited in claim 4 wherein the nitrile rubber of the surface portion is fluorinated.

6. The rotary cone rock bit as recited in claim 5 wherein the nitrile rubber of the surface portion is treated with sulfur.

7. The rotary cone rock bit as recited in claim 6 wherein the nitrile rubber of the surface portion is molecularly bonded to an organic molecule that is not a nitrile rubber.

8. The rotary cone rock bit as recited in claim 7 wherein the organic molecule comprises a fluorinated compound.

9. The rotary cone rock bit as recited in claim 8 wherein the fluorinated compound is selected from the group consisting of fluoropolymers.

10. The rotary cone rock bit as recited in claim 1 wherein the surface material comprises a metal sulfide selected from the group consisting of tungsten disulfide and molybdenum disulfide.

11. A rotary cone rock bit for drilling subterranean formations comprising;

a bit body including a plurality of journal pins each extending from a leg portion of the bit and having a bearing surface;

a cutter cone rotatably mounted on each journal pin and including a bearing surface;

a pressure-compensated grease reservoir in communication with such bearing surfaces;

a grease in the grease reservoir and adjacent the bearing surfaces; and a dynamic O-ring seal for retaining the grease in the bearing comprising:

a body formed from a resilient elastomeric composition; and a surface portion integral with the body for engaging a journal pin and a cone and having a surface with properties different from the properties of the body, wherein the surface portion comprises a material different from the elastomeric composition that is molecularly bonded to the elastomeric composition, and wherein the surface material comprises a metal sulfide selected from the group consisting of tungsten disulfide and molybdenum disulfide.

12. A rotary cone rock bit for drilling subterranean formations comprising;

a bit body including a plurality of journal pins each extending from a leg portion of the bit and having a bearing surface;

a cutter cone rotatably mounted on each journal pin and including a bearing surface;

a pressure-compensated grease reservoir in communication with such bearing surfaces;

a grease in the grease reservoir and adjacent the bearing surfaces; and a dynamic O-ring seal for retaining the grease in the bearing comprising:

a body formed from a resilient elastomeric composition; and a surface portion integral with the body for engaging a journal pin and a cone and having a surface with properties different from the properties of the body, wherein the body comprises a nitrile rubber, wherein the surface portion comprises nitrile rubber treated by the group consisting of halogenation, fluorination, and sulfur treatment, and wherein the surface portion has a molecular structure different from the molecular structure of the nitrile rubber of the body.

13. A rotary cone rock bit for drilling subterranean formations comprising;

a bit body including a plurality of journal pins each extending from a leg portion of the bit and having a bearing surface;

a cutter cone rotatably mounted on each journal pin and including a bearing surface;

a pressure-compensated grease reservoir in communication with such bearing surfaces;

a grease in the grease reservoir and adjacent the bearing surfaces; and a dynamic O-ring seal for retaining the grease in the bearing comprising:

a body formed from a resilient elastomeric composition; and a surface portion integral with the body for engaging a journal pin and a cone and having a surface with properties different from the properties of the body, wherein the body comprises a nitrile rubber, wherein the surface portion comprises nitrile rubber treated by the group consisting of halogenation, fluorination, and sulfur treatment, wherein the surface portion has a molecular structure different from the molecular structure of the nitrile rubber of the body, and wherein the nitrile rubber of the surface portion is molecularly bonded to an organic molecule that is not a nitrile rubber molecule.

14. A rotary cone rock bit for drilling subterranean formations comprising;

a bit body including a plurality of journal pins each extending from a leg portion of the bit and having a bearing surface;

a cutter cone rotatably mounted on each journal pin and including a bearing surface;

a pressure-compensated grease reservoir in communication with such bearing surfaces;

a grease in the grease reservoir and adjacent the bearing surfaces; and a dynamic O-ring seal for retaining the grease in the bearing comprising:

a body formed from a resilient elastomeric composition; and a surface portion integral with the body for engaging a journal pin and a cone and having a surface with properties different from the properties of the body, wherein the body comprises a nitrile rubber, wherein the surface portion comprises nitrile rubber treated by the group consisting of halogenation, fluorination, and sulfur treatment, wherein the surface portion has a molecular structure different from the molecular structure of the nitrile rubber of the body, and wherein the nitrile rubber of the surface portion is molecularly bonded to an organic molecule comprising a fluorinated compound.

15. A rotary cone rock bit for drilling subterranean formations comprising;

a bit body including a plurality of journal pins each extending from a leg portion of the bit and having a bearing surface;

a cutter cone rotatably mounted on each journal pin and including a bearing surface;

a pressure-compensated grease reservoir in communication with such bearing surfaces;

a grease in the grease reservoir and adjacent the bearing surfaces; and a dynamic O-ring seal for retaining the grease in the bearing comprising:

a body formed from a resilient elastomeric composition; and a surface portion integral with the body for engaging a journal pin and a cone and having a surface with properties different from the properties of the body, wherein the body comprises a nitrile rubber, wherein the surface portion comprises nitrile rubber treated by the group consisting of halogenation, fluorination, and sulfur treatment, wherein the surface portion has a molecular structure different from the molecular structure of the nitrile rubber of the body, and wherein the nitrile rubber of the surface portion is molecularly bonded to an organic molecule comprising a fluorinated compound selected from the group consisting of fluoropolymers.

16. A rotary cone rock bit for drilling subterranean formations comprising;

a bit body including a plurality of journal pins each extending from a leg portion of the bit and having a bearing surface;

a cutter cone rotatably mounted on each journal pin and including a bearing surface;

a pressure-compensated grease reservoir in communication with such bearing surfaces;

a grease in the grease reservoir and adjacent the bearing surfaces; and a dynamic O-ring seal for retaining the grease in the bearing comprising:

a body formed from a resilient elastomeric composition; and a permanent surface portion integral with and enclosing the body formed from a surface enhancing material having a molecular makeup different from the molecular makeup of the body, wherein the surface portion comprises a uniform layer of surface enhancing material that is molecularly bonded with the body of the seal.

17. The rotary cone rock bit as recited in claim 16 wherein the resilient elastomeric composition is selected from the group of materials consisting of fluoroelastomers, carboxylated elastomers, and HSN elastomers.

18. The rotary cone rock bit as recited in claim 16 wherein the uniform layer of surface enhancing material has a thickness in the range of from 100 to 500 Angstroms.

19. The rotary cone rock bit as recited in claim 18 wherein the surface enhancing material is selected from the group of materials consisting of fluoropolymers, polyethylene polymers, tungsten disulfide, molybdenum disulfide, silicone polymers, and urethane polymers.

20. The rotary cone rock bit as recited in claim 19 wherein the surface enhancing material is polytetrafluoroethylene.

21. The rotary cone rock bit as recited in claim 20 wherein the surface enhancing material is applied by plasma polymerization.

22. The rotary cone rock bit as recited in claim 19 wherein the surface enhancing material is tungsten disulfide.

23. A rotary cone rock bit for drilling subterranean formations comprising;

a bit body including a plurality of journal pins each extending from a leg portion of the bit and having a bearing surface;

a cutter cone rotatably mounted on each journal pin and including a bearing surface;

a pressure-compensated grease reservoir in communication with such bearing surfaces;

a grease in the grease reservoir and adjacent the bearing surfaces; and a dynamic O-ring seal for retaining the grease in the bearing comprising:

a body formed from a resilient elastomeric composition selected from the group of materials consisting of fluoroelastomers, carboxylated elastomers, and HSN elastomers; and a surface comprising an integral surface enhancing material having a molecular makeup different from the molecular makeup of the body, wherein the surface comprises a uniform layer of surface enhancing material different from the material makeup of the elastomeric composition, wherein the layer of surface enhancing material encloses and molecularly bonds with the body of the seal, wherein the uniform layer of surface enhancing material has a thickness in the range of from 100 to 500 Angstroms, wherein the surface enhancing material is tungsten disulfide.

24. A rotary cone rock bit for drilling subterranean formations comprising;

a bit body including a plurality of journal pins each extending from a leg portion of the bit and having a bearing surface;

a cutter cone rotatably mounted on each journal pin and including a bearing surface;

a pressure-compensated grease reservoir in communication with such bearing surfaces;

a grease in the grease reservoir and adjacent the bearing surfaces; and a dynamic O-ring seal for retaining the grease in the bearing comprising:

a body formed from a resilient elastomeric material selected from the group consisting of fluoroelastomers, carboxylated elastomers, and HSN elastomers; and a surface comprising a uniform layer of surface enhancing material having a molecular makeup different than the molecular makeup of the elastomeric composition, the material enclosing and being molecularly bonded to the body to form a permanent enhanced surface for contacting adjacent surfaces of the journal pin and the cone, the material being selected from the group of materials consisting of metal sulfides, fluoropolymers, polyethylene polymers, silicone polymers, and urethane polymers.

25. The rotary cone rock bit as recited in claim 24 wherein the layer of surface enhancing material has a thickness in the range of from 100 to 500 Angstroms.

26. The rotary cone rock bit as recited in claim 25 wherein the surface enhancing material comprises polytetrafluoroethylene.

27. The rotary cone rock bit as recited in claim 26 wherein the layer surface enhancing material is applied to the body of the O-ring seal by plasma polymerization.

28. The rotary cone rock bit as recited in claim 25 wherein the surface enhancing material comprises tungsten disulfide.

29. A rotary cone rock bit for drilling subterranean formations comprising;

a bit body including a plurality of journal pins each extending from a leg portion of the bit and having a bearing surface;

a cutter cone rotatably mounted on each journal pin and including a bearing surface;

a pressure-compensated grease reservoir in communication with such bearing surfaces;

a grease in the grease reservoir and adjacent the bearing surfaces; and a dynamic O-ring seal for retaining the grease in the bearing comprising:

a body formed from a resilient elastomeric material selected from the group consisting of fluoroelastomers, carboxylated elastomers, and HSN elastomers; and a surface comprising a uniform layer of surface enhancing material having a molecular makeup different than the molecular makeup of the elastomeric composition, the material enclosing and being molecularly bonded to the body to form an enhanced surface for contacting adjacent surfaces of the journal pin and the cone, wherein the layer of surface enhancing material has a thickness in the range of from 100 to 500 Angstroms, and wherein the surface enhancing material comprises tungsten disulfide.

* * * * *